US009618221B2

(12) United States Patent
Chang

(10) Patent No.: US 9,618,221 B2
(45) Date of Patent: Apr. 11, 2017

(54) VENTILATION DEVICE

(75) Inventor: Shun-Chen Chang, Taiwan (CN)

(73) Assignee: Delta Electronics, Inc., Taiwan (CN)

( * ) Notice: Subject to any disclaimer, the term of this patent is extended or adjusted under 35 U.S.C. 154(b) by 585 days.

(21) Appl. No.: 14/122,499

(22) PCT Filed: May 7, 2011

(86) PCT No.: PCT/CN2011/074741

§ 371 (c)(1),
(2), (4) Date: Nov. 27, 2013

(87) PCT Pub. No.: WO2012/162868

PCT Pub. Date: Dec. 6, 2012

(65) Prior Publication Data

US 2014/0094109 A1 Apr. 3, 2014

(51) Int. Cl.
*F24F 7/02* (2006.01)

(52) U.S. Cl.
CPC ..... *F24F 7/025* (2013.01)

(58) Field of Classification Search
CPC ..... F24F 7/025
USPC ..... 454/366, 8, 15
See application file for complete search history.

(56) References Cited

U.S. PATENT DOCUMENTS 4,648,312 A * 3/1987 Schad ..... F23L 17/10
416/227 A

* cited by examiner

*Primary Examiner* — Helena Kosanovic
(74) *Attorney, Agent, or Firm* — Banner & Witcoff, Ltd.

(57) ABSTRACT

A ventilation device includes a passage unit (100), a wind turbine (200) and a fan (300). The wind turbine (200) is provided above the passage unit (100), and the fan (300) is provided within the wind turbine (200). The rotation of the wind turbine (200) drives the fan (300) to rotate, so that the air within the passage (100) is exhausted by the fan.

7 Claims, 6 Drawing Sheets

VENTILATION DEVICE

This application is a national stage application of co-pending PCT application PCT/CN2011/074741 filed May 27, 2011. The disclosure of this application is expressly incorporated herein by reference in its entirety.

BACKGROUND OF THE INVENTION

Field of the Invention

The invention relates to ventilation apparatuses, and more particularly to ventilation apparatuses that can provide functions of air discharge without use of electric power.

Description of the Related Art

Generally, there are two types of conventional ventilation apparatuses disposed on the rooftops of houses. One conventional ventilation apparatus is operated by electric power and is provided with an electric fan. Air can be expelled from a building by the electric fan. Accordingly, operation of this conventional ventilation apparatus consumes electric power.

The other conventional ventilation apparatus is operated without use of the electric power. Specifically, a spherical drainage fan is disposed on the top of the conventional ventilation apparatus. Based upon the principle of hot-air rising, indoor hot air rises to the top of the building. Then, the indoor hot air drives the spherical drainage fan to rotate and is expelled thereby. Nevertheless, the spherical drainage fan cannot rapidly expel the indoor hot air. Here, the spherical drainage fan is mainly used to expel rainwater by centrifugal force generated by the rotation thereof, thereby preventing the rainwater from entering the building. As the other conventional ventilation apparatus is operated only by the principle of hot-air rising, an expellant speed for the indoor hot air may be very slow if only a minor temperature difference exists between the interior and exterior of the building.

BRIEF SUMMARY OF THE INVENTION

A detailed description is given in the following embodiments with reference to the accompanying drawings.

An object of the invention is to provide a ventilation apparatus utilizing a wind turbine to rotate an exhaust fan. Indoor air is expelled by the exhaust fan, achieving a ventilation effect without use of electric power.

To achieve the aforementioned object, an exemplary embodiment of the invention provides a ventilation apparatus comprising a channel unit, a wind turbine, and an exhaust fan. The channel unit comprises a first channel. The wind turbine is rotatably disposed on the channel unit and comprises an airflow space communicating with the first channel. A second channel is formed between the inside of the wind turbine and the outside of the channel unit. The exhaust fan is connected to the wind turbine and is disposed in the second channel. The first channel, airflow space, and second channel communicate with each other. When the wind turbine rotates to bring the exhaust fan to rotate, the exhaust fan brings air to the second channel through the first channel and airflow space.

To achieve the aforementioned object, another exemplary embodiment of the invention provides a ventilation apparatus comprising a channel unit, a wind turbine, and an exhaust fan. The channel unit comprises a first channel. The wind turbine is rotatably disposed on the channel unit and comprises an airflow space communicating with the first channel. A second channel is formed between an inside of the wind turbine and an outside of the channel unit. The exhaust fan is connected to the wind turbine and is disposed in the first channel. The first channel, airflow space, and second channel communicate with each other. When the wind turbine rotates to bring the exhaust fan to rotate, the exhaust fan brings air to the second channel through the first channel and airflow space.

Accordingly, in the ventilation apparatuses of the invention, outdoor wind can blow the wind turbine to rotate. The wind turbine can then bring the exhaust fan to rotate, expelling air from a building, and further achieving a ventilation effect. Moreover, because of the configuration of the wind turbine and channel unit, rainwater cannot easily enter the channel unit. Thus, a rainproof effect can be provided by the ventilation apparatuses of the invention.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
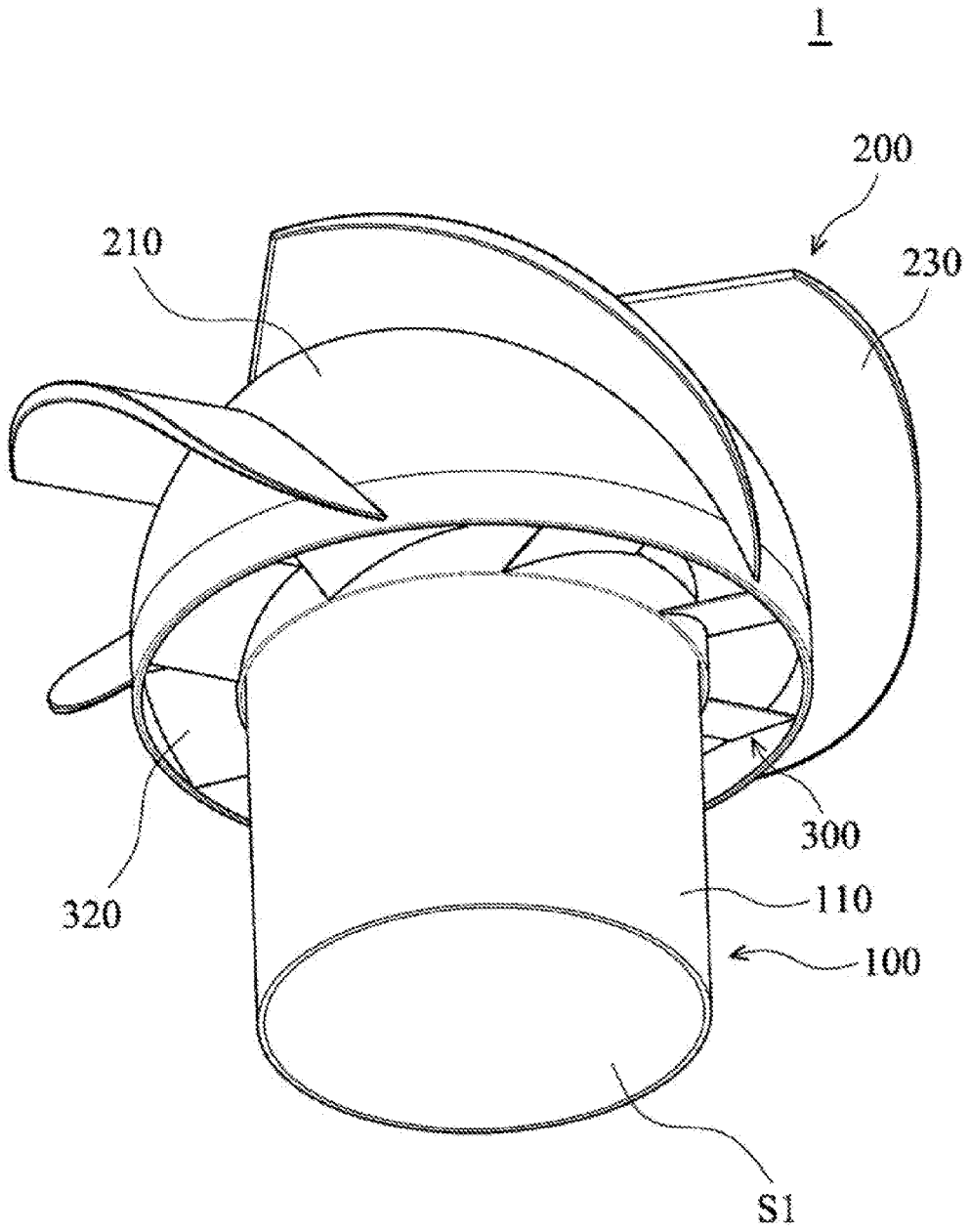
FIG. 1 is a schematic perspective view of a ventilation apparatus of a first embodiment of the invention.
Figure 2:
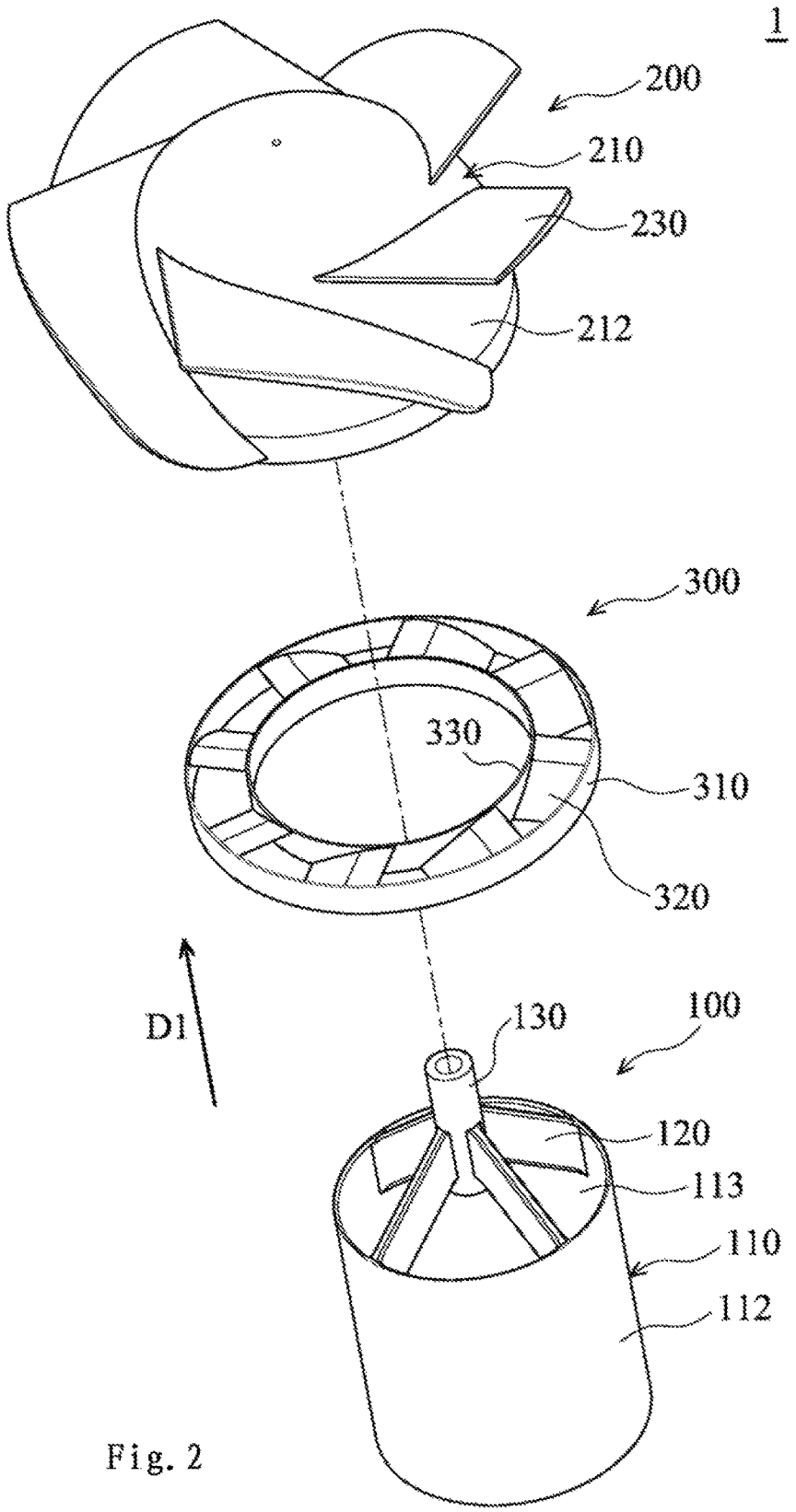
FIG. 2 is an exploded perspective view of the ventilation apparatus of the first embodiment of the invention.
Figure 3:
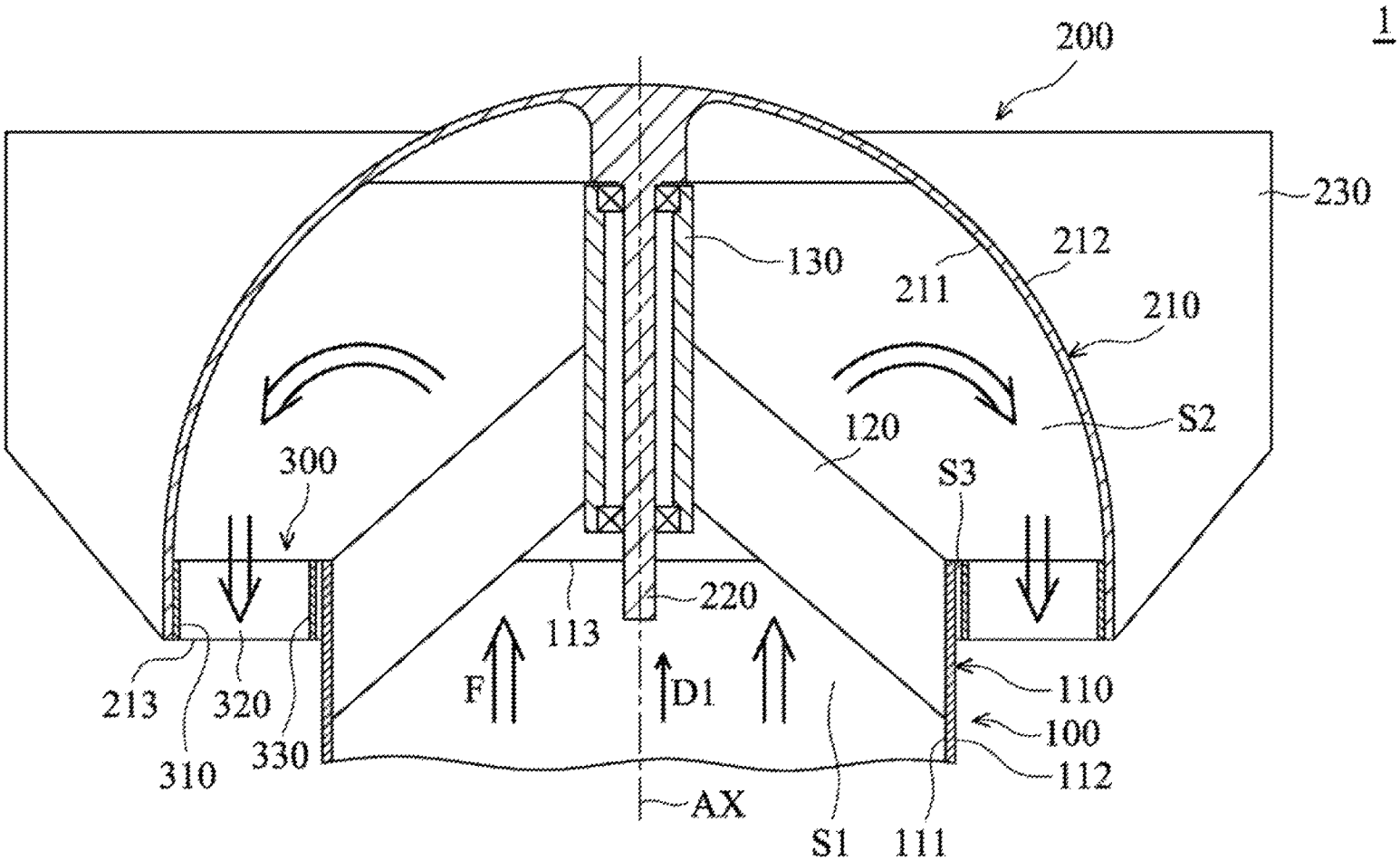
FIG. 3 is a schematic cross section of the ventilation apparatus of the first embodiment of the invention.

Referring to FIGS. 1, 2, and 3, a ventilation apparatus 1 comprises a channel unit 100, a wind turbine 200, and a first exhaust fan 300. The ventilation apparatus 1 may be arranged on a roof of a building and may connect to an indoor space thereof via the channel unit 100.

The channel unit 100 comprises a channel body 110, a plurality of connection units 120, and a fixing bearing 130. The channel body 110 may be a hollow cylinder extending along an extension direction D1. The top of the channel body 110 is formed with a first opening 113. A first channel S1 is formed in the channel body 110 and communicates with the first opening 113.

Each of the connection units 120 may be an elongated structure and connects an inner wall 111 of the channel body 110 to the fixing bearing 130. The connection units 120 radially extend from the fixing bearing 130 and are alternately arranged. The fixing bearing 130 extends along the extension direction D1 and is located above the channel body 110 and a rotational axis AX of the wind turbine 200. Here, the rotation axis AX can also be a central axis of the channel body 110, and the extension direction D1 is parallel to the rotational axis AX.

The wind turbine 200 is rotatably disposed on the channel unit 100 and rotates about the rotational axis AX. An airflow space S2 is formed in the wind turbine 200 and communicates with the first channel S1. Additionally, a second channel S3 is formed between an inside of the wind turbine 200 and an outside of the channel body 110.

The wind turbine 200 comprises an outer hub 210, a fan shaft 220, and a plurality of turbine blades 230. The outer hub 210 may be a semi-spherical housing. The airflow space S2 is formed in the outer hub 210. In this embodiment, the top of the outer hub 210 is configured as a closed housing, and the bottom of the outer hub 210 is formed with a second opening 213 communicating with the airflow space S2. The outer hub 210 is disposed above the channel body 110. One end of the channel body 110 extends to the airflow space S2 through the second opening 213, such that the second channel S3 is formed between an inner surface 211 of the outer hub 210 and an outside wall 112 of the channel body 110.

FIG. 3 is a schematic cross section of the ventilation apparatus of the first embodiment of the invention. As shown in FIG. 3, the first channel S1, airflow space S2, and second channel S3 communicate with each other. The second opening 213 of the outer hub 210 is lower than the first opening 113 of the channel body 110, and the first opening 113 is covered by the outer hub 210. Accordingly, rainwater is prevented from entering the first channel S1 in the channel unit 100 through the first opening 113. Namely, the ventilation apparatus 1 of this embodiment can provide a rainproof function.

The fan shaft 220 is rotatably disposed in the fixing bearing 130. One end of the fan shaft 220 is connected to the outer hub 210 and extends along the rotational axis AX to penetrate the fixing bearing 130. The turbine blades 230 are disposed on an outer surface of the outer hub 210. Here, the turbine blades 230 extend outward from the outer hub 210 and are separated from each other. Accordingly, when the wind blows the wind turbine 200, the outer hub 210, fan shaft 220, and turbine blades 230 can rotate about the rotational axis AX.

The first exhaust fan 300 is connected to the wind turbine 200 and is disposed in the second channel S3. The first exhaust fan 300 comprises an outer fixed ring 310, a plurality of first exhaust blades 320, and an inner fixed ring 330. The outer fixed ring 310 extends along the inner surface 211 of the outer hub 210 and is fixed to the inside of the wind turbine 200. The first exhaust blades 320 are alternately disposed on the outer fixed ring 310 and are connected to the inner fixed ring 330. The inner fixed ring 330 surrounds the outside of the channel body 110, but is not connected to the channel body 110. In another embodiment, the outer fixed ring 310 is integrally formed with the outer hub 210. Namely, the outer fixed ring 310 may be a part of the outer hub 210.

As shown in FIG. 3, when the outdoor wind blows the turbine blades 230, the wind turbine 200 rotates to bring the first exhaust fan 300 to rotate about the rotational axis AX. At this point, the first exhaust fan 300 brings air in the first channel S1 to flow along the extension direction D1. The air flows along an airflow passage F to the second channel S3 and is then expelled therefrom. Namely, when the ventilation apparatus 1 is arranged on the roof of the building, the channel body 110 may be connected to a ventilation pipe (not shown) disposed on the roof and communicating with the indoor space. Accordingly, the indoor air may flow to the second channel S3 via the first channel S1 and airflow space S2 and may be expelled from the second channel S3.

When there is no wind outdoors, indoor hot air may flow to the first channel S1 via the ventilation pipe and may then flow to the second channel S3 via the airflow passage F, first channel S1, and airflow space S2. The indoor hot air is then expelled from the second channel S3. Moreover, if the indoor hot air is provided with a high flow rate, the indoor hot air can blow the first exhaust fan 300 to rotate, accelerating discharge of the indoor air, and thereby enhancing the efficiency of ventilation.

Figure 4:
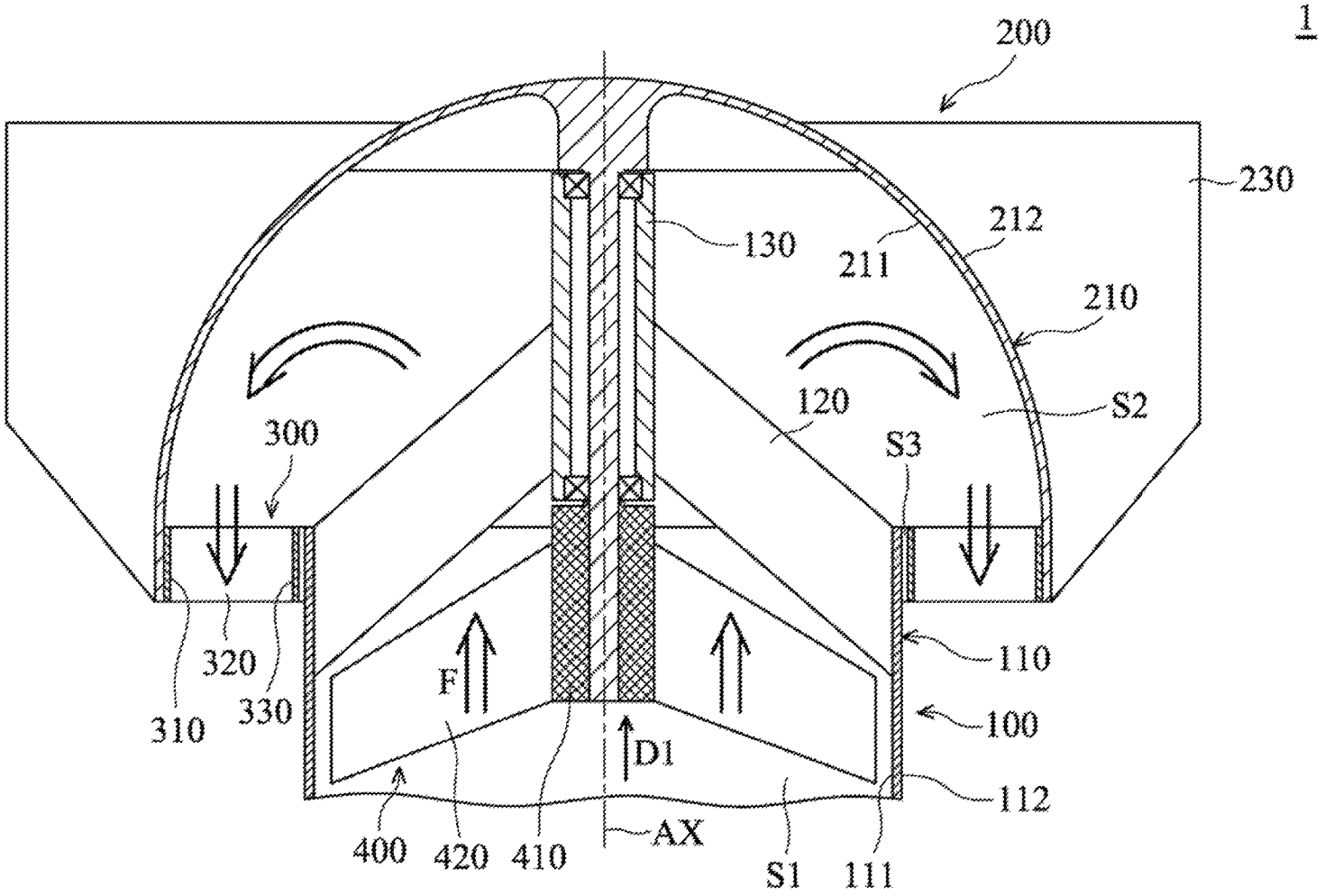
FIG. 4 is a schematic cross section of a ventilation apparatus of a second embodiment of the invention.

FIG. 4 is a schematic cross section of a ventilation apparatus of a second embodiment of the invention. This embodiment differs from the first embodiment in that the ventilation apparatus 1 of this embodiment further comprises a second exhaust fan 400 disposed in the first channel S1. The second exhaust fan 400 comprises an inner hub 410 and a plurality of second exhaust blades 420. The inner hub 410 is disposed in the first channel S1 and is connected to the other end of the fan shaft 220 of the wind turbine 200. The second exhaust blades 420 are alternately disposed on the inner hub 410 and radially extend outward from the inner hub 410.

When the outdoor wind blows the turbine blades 230, the wind turbine 200 rotates to bring the first exhaust fan 300 and second exhaust fan 400 to rotate about the rotational axis AX. At this point, the first exhaust fan 300 and second exhaust fan 400 bring air in the first channel S1 to flow along the airflow passage F. Similarly, if the indoor hot air is provided with the high flow rate, the indoor hot air can blow the first exhaust fan 300 and second exhaust fan 400 to rotate. Accordingly, the second exhaust fan 400 additionally included in this embodiment can further increase the speed of the air flowing along the airflow passage F, accelerating the discharge of the indoor air, and thereby enhancing the efficiency of ventilation.

Figure 5:
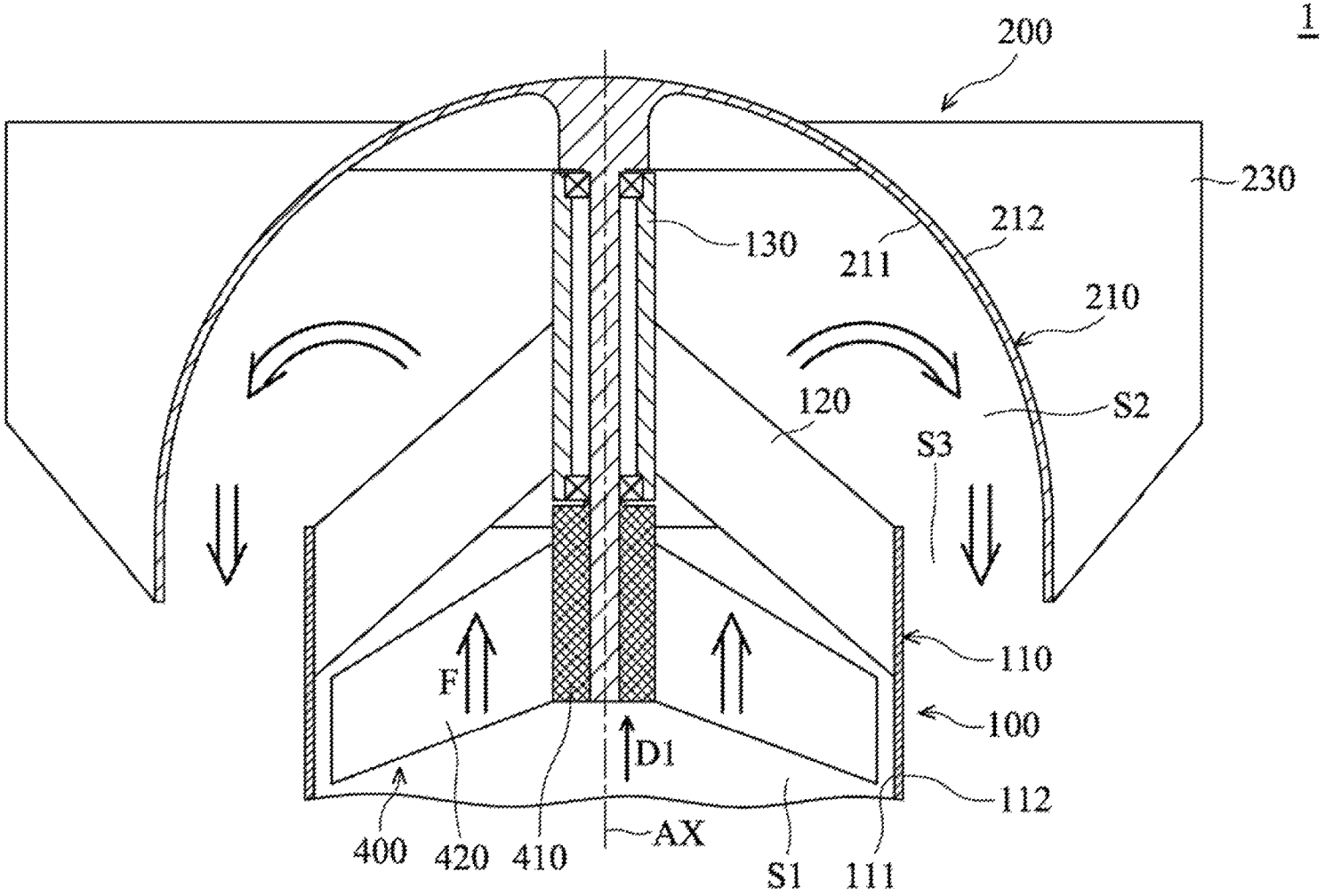
FIG. 5 is a schematic cross section of a ventilation apparatus of a third embodiment of the invention.

FIG. 5 is a schematic cross section of a ventilation apparatus of a third embodiment of the invention. In this embodiment, the second exhaust fan 400 is disposed in the first channel S1, whilst no exhaust fan is disposed in the second channel S3. Similarly, when the wind turbine 200 rotates to bring the second exhaust fan 400 to rotate, the second exhaust fan 400 brings air to the second channel S3 via the first channel S1 and airflow space S2.

Figure 6:
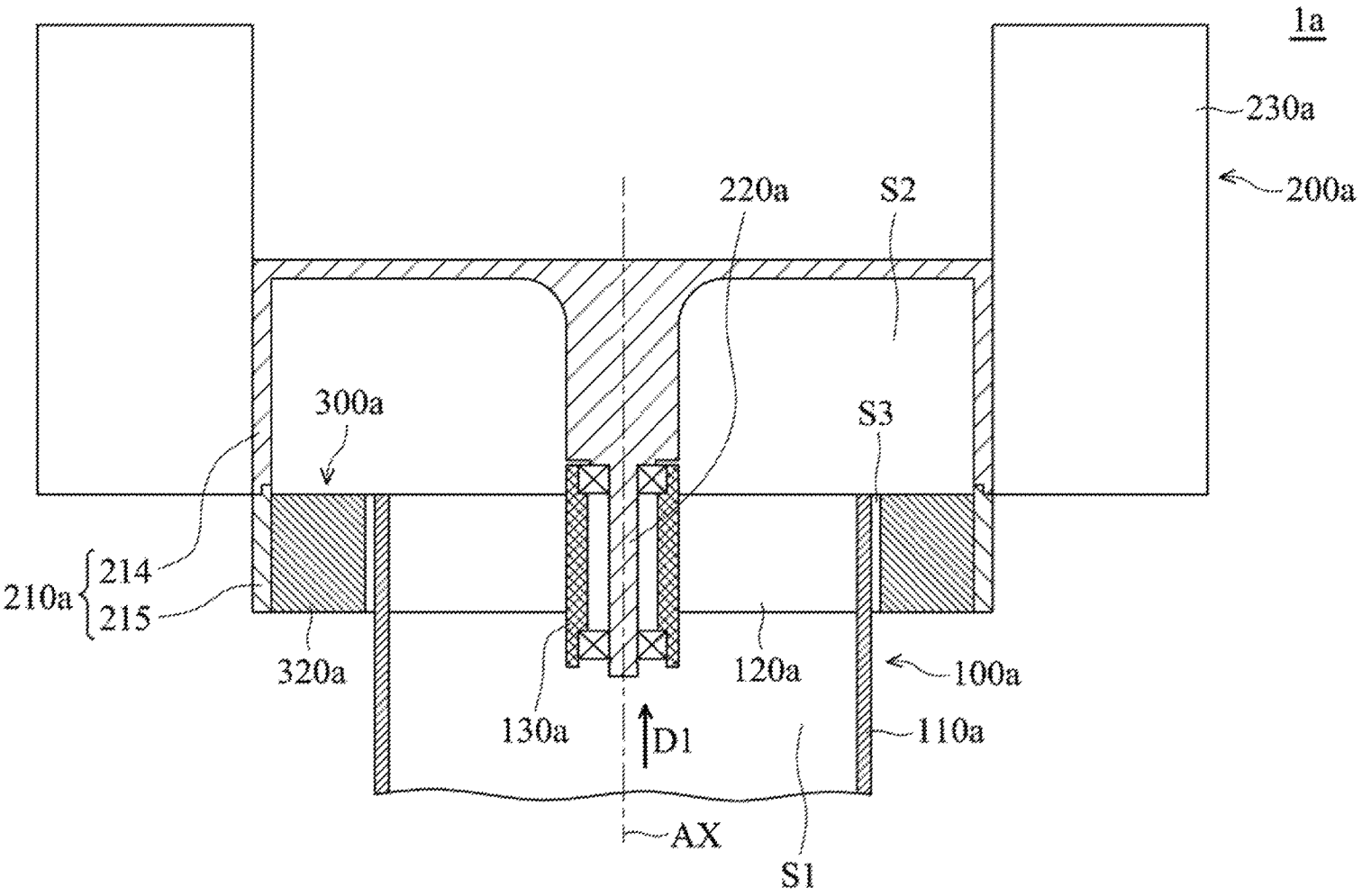
FIG. 6 is a schematic cross section of a ventilation apparatus of a fourth embodiment of the invention.

FIG. 6 is a schematic cross section of a ventilation apparatus of a fourth embodiment of the invention. In this embodiment, a fixing bearing 130*a* of a channel unit 100*a* is disposed in the first channel S1 of the channel unit 100*a*, and multiple connection units 120*a* are perpendicular to a sidewall of the fixing bearing 130*a* and extend to a channel body 110*a*. An outer hub 210*a* of a wind turbine 200*a* is configured as a cylindrical structure. The wind turbine 200*a* protrudes from the top of the outer hub 210*a*.

The outer hub 210*a* comprises a first housing 214 and a second housing 215. The second housing 215 is annular and is combined with the first housing 214 along the extension direction D1. A first exhaust fan 300*a* comprises a plurality of first exhaust blades 320*a*, but comprises no outer fixed ring and inner fixed ring. The first exhaust blades 320*a* extend inward from an inner wall of the second housing 215. In another embodiment, the inner fixed ring may be connected to the first exhaust blades 320*a*.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A ventilation apparatus, comprising:

a channel unit comprising a first channel with a first opening;

a wind turbine with a second opening at bottom, rotatably disposed on the channel unit and comprising an airflow space communicating with the first channel, the second opening being lower than the first opening wherein a second channel is formed between an inside of the wind turbine and an outside of the channel unit; and a first exhaust fan connected to the wind turbine and disposed in the second channel, wherein, the first channel, the airflow space, and the second channel communicate with each other, and when the wind turbine rotates to bring the first exhaust fan to rotate, the first exhaust fan brings air to the second channel through the first channel and the airflow space;

wherein the first exhaust fan comprises:

an outer fixed ring fixed directly to the inside of the wind turbine;

a plurality of first exhaust blades alternately disposed on the outer fixed ring; and an inner fixed ring connected to the plurality of first exhaust blades and surrounding the outside of the channel unit.

2. The ventilation apparatus as claimed in claim 1, further comprising a second exhaust fan disposed in the first channel, wherein, when the wind turbine rotates to bring the second exhaust fan to rotate, the second exhaust fan brings the air to the second channel through the first channel and airflow space.

3. The ventilation apparatus as claimed in claim 2, wherein the second exhaust fan comprises:

an inner hub connected to the wind turbine; and a plurality of second exhaust blades disposed on the inner hub.

4. The ventilation apparatus as claimed in claim 1, wherein the channel unit comprises:

a channel body with the first channel;

a connection unit disposed on the channel body; and a fixing bearing connected to the connection unit.

5. The ventilation apparatus as claimed in claim 4, wherein the wind turbine comprises:

a fan shaft rotatably disposed in the fixing bearing;

an outer hub disposed on one end of the fan shaft and having the airflow space; and a plurality of turbine blades disposed on the outer hub.

6. The ventilation apparatus as claimed in claim 5, further comprising a second exhaust fan disposed in the first channel, wherein, when the wind turbine rotates to bring the second exhaust fan to rotate, the second exhaust fan brings the air to the second channel through the first channel and airflow space.

7. The ventilation apparatus as claimed in claim 6, wherein an other end of the fan shaft penetrates the fixing bearing, and the second exhaust fan comprises:

an inner hub connected to said other end of the fan shaft; and a plurality of second exhaust blades disposed on the inner hub.

* * * * *